US009777539B2

(12) United States Patent
Jones et al.

(10) Patent No.: US 9,777,539 B2
(45) Date of Patent: Oct. 3, 2017

(54) COMPOSITE COMPONENT DEPLOYMENT CONFIGURATIONS

(71) Applicant: Magma Global Limited, Portsmouth (GB)

(72) Inventors: Martin Peter William Jones, Chichester (GB); Richard Damon Goodman Roberts, Hampshire (GB); Charles Alexander Tavner, London (GB)

(73) Assignee: Magma Global Limited, Portsmouth (GB)

( * ) Notice: Subject to any disclaimer, the term of this patent is extended or adjusted under 35 U.S.C. 154(b) by 0 days.

(21) Appl. No.: 14/057,310

(22) Filed: Oct. 18, 2013

(65) Prior Publication Data

US 2014/0041879 A1 Feb. 13, 2014

Related U.S. Application Data

(63) Continuation of application No. PCT/GB2012/000355, filed on Apr. 18, 2012.

(30) Foreign Application Priority Data

Apr. 18, 2011 (GB) ..... 1106473.0

(51) Int. Cl.
*E21B 17/01* (2006.01)
*F16L 27/12* (2006.01)
(Continued)

(52) U.S. Cl.
CPC ..... *E21B 17/012* (2013.01); *E21B 17/01* (2013.01); *E21B 19/002* (2013.01); *E21B 33/038* (2013.01); *F16L 27/12* (2013.01)

(58) Field of Classification Search
CPC ..... E02B 17/00; E21B 17/01; E21B 33/035; E21B 33/038; E21B 33/076; E21B 7/128;
(Continued)

(56) References Cited

U.S. PATENT DOCUMENTS 3,572,272 A * 3/1971 Dixon ..... B63B 21/502 114/294
4,728,224 A * 3/1988 Salama ..... B63B 21/502 166/367
(Continued)

FOREIGN PATENT DOCUMENTS

WO 00/08262 A1 2/2000
WO 00/66927 A1 11/2000
(Continued)

OTHER PUBLICATIONS

International Search Report and Written Opinion in corresponding PCT Application No. PCT/GB2012/000355 dated Aug. 1, 2013.

*Primary Examiner* — Matthew R Buck
*Assistant Examiner* — Edwin Toledo-Duran
(74) *Attorney, Agent, or Firm* — Levy & Grandinetti

(57) ABSTRACT

A riser system (202) comprises a riser (204) to be secured between a floating body (206) and a subsea location (209). The riser comprises a composite material formed of at least a matrix and one or more reinforcing elements embedded within the matrix. In use, the riser (204) comprises an upper portion (214) extending from the floating body (206) and having a region arranged to be in tension, a lower portion (216) extending from the subsea location (209) and having a region arranged to be in tension, and an intermediate portion (218) located between the upper and lower portions (214, 216) and having a region arranged to be in compression. A flow-line jumper (302, 402) configured to be secured between two subsea locations, a flow-line jumper arrange-
(Continued)

ment comprising a flow-line jumper (302, 402) and a method of forming a flow-line jumper 302, 402 are also disclosed.

28 Claims, 4 Drawing Sheets

(51) Int. Cl.
*E21B 33/038* (2006.01)
*E21B 19/00* (2006.01)

(58) Field of Classification Search
CPC ..... E21B 19/16; E21B 19/161; E21B 19/162; E21B 19/163; E21B 19/164; E21B 19/165; E21B 19/166; E21B 19/167; E21B 19/168; E21B 19/18
USPC ..... 166/367, 368, 344, 351, 352, 380; 405/169, 170, 224.2, 224.3, 224.4
See application file for complete search history.

(56) References Cited

U.S. PATENT DOCUMENTS 4,740,109 A * 4/1988 Horton ..... B63B 21/502 114/265
4,821,804 A * 4/1989 Pierce ..... E02B 17/00 166/367
5,330,294 A * 7/1994 Guesnon ..... E21B 17/012 166/350
5,363,920 A * 11/1994 Alexander ..... B63B 21/50 166/350
6,062,769 A * 5/2000 Cunningham ..... E02D 27/04 166/350
6,276,456 B1 * 8/2001 Head ..... E21B 17/015 166/350
6,538,198 B1 * 3/2003 Wooters ..... E21B 17/206 138/111
7,150,324 B2 * 12/2006 Laursen ..... E21B 19/24 166/355
7,398,697 B2 * 7/2008 Allen et al. ..... 73/800
8,387,707 B2 * 3/2013 Adamek ..... E21B 17/07 166/338
9,343,199 B2 * 5/2016 Fogg ..... H01B 7/046
2002/0168232 A1 * 11/2002 Xu ..... E21B 17/01 405/224
2006/0000615 A1 * 1/2006 Choi ..... B63B 27/24 166/352
2007/0048093 A1 * 3/2007 Bhat ..... B63B 21/502 405/224.2
2010/0018717 A1 * 1/2010 Espinasse ..... E21B 17/012 166/346
2012/0031620 A1 * 2/2012 Phadke ..... E21B 17/01 166/336
2012/0160510 A1 * 6/2012 Bhat ..... B63B 27/24 166/367
2014/0044493 A1 * 2/2014 Hatton ..... E21B 17/015 405/224.2

FOREIGN PATENT DOCUMENTS

WO 2007/083238 A2 7/2007
WO 2010/030160 A1 3/2010
WO 2011/028432 A2 3/2011

* cited by examiner

COMPOSITE COMPONENT DEPLOYMENT CONFIGURATIONS

FIELD OF THE INVENTION

The present invention relates to various deployment configurations for subsea composite components.

BACKGROUND OF THE INVENTION

There are several advantages to having a straight riser from the seabed to a surface platform or production vessel that are widely acknowledged in the industry. These include the simplicity of the arrangement, minimisation of pipe and the ability to use a dry tree. This configuration is typically not possible on a floating production vessel or tension legged platforms because a straight riser is unable to absorb the changes in length required to accommodate wave induced or tidal motion. This motion can sometimes be accommodated by heave compensators such as hydraulic rams on the platform and a short flexible interconnect from the top of the riser to the platform. However a direct connection of seabed to platform without or with minimal expensive and complex compensation equipment would be desirable.

Also, it is preferred in the industry to intentionally maintain a riser in tension along its entire length. This is due to the problems which can arise in the event of axial compressive forces being present in regions of the riser, which may lead to issues such as buckling and the like.

The industry has proposed a riser configuration in which the riser extends initially vertically from the seabed, forms a gentle "S"-bend and then terminates into the surface platform or vessel again at a vertical orientation. This configuration is able to absorb substantial vertical motion at the platform or vessel yet uses very little additional pipe. This configuration is defined in the art as a Compliant Vertical Access Riser (CVAR), and heretofore CVAR systems have generally been formed from steel. However the industry has been reluctant to deploy this configuration because it may result in a region of the pipe being in compression which is usually intentionally avoided. Such compression is particularly undesirable in that the geometry of a conventional CVAR includes non-linear portions with extended regions of bending. Such non-linear geometry in combination with compressive axial loading can cause unpredictable behaviour of the riser and may more readily result in yield limits being exceeded.

Furthermore, the combination of dynamic loads and the compressed region of the pipe, and also the typically non-linear geometries, make global analysis and modelling of such riser configurations very challenging as the riser can adopt a large number of shapes. This results in problems predicting the behaviour of such riser configurations under dynamic loads and, in particular, problems in predicting the risk of buckling and the consequential damage that may be incurred under dynamic loads. As such, without confidence in the analysis and modelling of such CVAR systems, the industry is reluctant to deploy them.

Furthermore, conventional CVAR systems may rely upon the attachment of additional weights and buoyancy elements at predetermined points along the riser to provide the required riser shape and to control any compression in the riser. Such additional weights and buoyancy elements add to the complexity and cost of the system and can complicate deployment and recovery of the riser.

Flow-line jumpers may provide compliance in compact space envelopes between two points of attachment, for example, between two fluid ports. Conventional jumpers manufactured from steel or the like typically comprise elbows connected by straight sections for ease of manufacture. These structures fail to minimise the space envelope for a required amount of compliance. Furthermore the presence of sharp 90 degree bends can increase the risk of hydrate build up and restrict hydrate removal operations such as pigging operations.

It is also known to form conduits or jumpers from unbonded flexibles. However, such conduits or jumpers may lose their shape during movement thereof making it difficult to manipulate the conduits or jumpers during deployment and recovery.

SUMMARY OF THE INVENTION

An aspect of the present invention may relate to a riser system comprising a riser to be secured between a floating body and a subsea location, wherein the riser comprises a composite material formed of at least a matrix and one or more reinforcing elements embedded within the matrix. In use, the riser may comprise or define an upper portion extending from the floating body and having a region arranged to be in tension, a lower portion extending from the subsea location and having a region arranged to be in tension, and an intermediate portion located between the upper and lower portions and having a region arranged to be in compression.

Accordingly, a portion of the riser is arranged to be in compression. This portion may be maintained in compression. In this respect, the composite material of the riser facilitates or permits the intermediate portion to be arranged in compression. Thus, problems and difficulties associated with prior art arrangements in which compression is generally avoided or is controlled at significant expense and complexity may be reduced or eliminated.

The intermediate portion may include some regions which are also in tension. In this respect, the intermediate portion may include locations of transition, in which axial compression transitions to axial compression. Multiple, locations of transition may be present.

The intermediate portion of the riser may be arranged to be in compression immediately upon deployment and connection between the vessel and the subsea location. Accordingly, the region of compression is an intentional design aspect, which is permitted by virtue of the properties of the composite material. Further, the region of compression may be defined and present when the riser is not exposed to dynamic load conditions.

The riser may be configured to provide a predetermined tension in the upper and/or lower portions and/or a predetermined compression in the intermediate portion. Accordingly, at least the compression in the intermediate portion is provided intentionally or by design.

The density and/or geometry of the riser may provide the predetermined tension in the upper and/or lower portions and the predetermined compression in the intermediate portion.

At least a portion of the riser may be configured to define a non-linear spatial arrangement to accommodate motion of the floating body relative to the subsea location. The intermediate portion may define a non-linear spatial arrangement.

The upper portion of the riser may extend generally linearly from the floating body towards the intermediate portion. The lower portion of the riser may extend generally linearly from the subsea location towards the intermediate portion.

The spatial arrangement of the riser may comprise or define a point of inflection. The point of inflection may be located within the intermediate portion of the riser.

The riser system may comprise weights and/or buoyancy elements attached to the riser.

The floating body may comprise at least one of a vessel, a Floating Production Storage and Offloading (FPSO) vessel, a floating platform, a Tension Leg Platform (TLP), a SPAR platform and a semi-submersible platform. However, any floating body as would be selected or understood in the art to possibly be associate with a riser may be utilised with the riser system.

The floating body may be a surface or near surface floating body.

The subsea location may be a seabed location.

The riser may be secured to a fluid port at the subsea location. The riser may be secured to a fluid port of a subsea wellhead arrangement or a fluid port of a subsea manifold.

The composite material may be configured to permit axial and/or bending strains of up to 6%, up to 4%, up to 2% or up to 1%.

The composite material may be configured to ensure that a thermally induced strain in the riser for a predetermined temperature change constitutes a smaller proportion of a maximum permitted strain in the riser than for a steel riser.

The composite material may be configured to ensure that a thermally induced strain in the riser for a temperature change of up to 500° C., a temperature change of up to 200° C., a temperature change of up to 100° C. or a temperature change of up to 80° C. constitutes a smaller proportion of a maximum permitted strain in the riser than for a steel riser.

The matrix may comprise a polymer material. The matrix may comprise a thermoplastic material and/or a thermoset material. The matrix may comprise at least one of a polyaryl ether ketone, a polyaryl ketone, a polyether ketone (PEK), a polyether ether ketone (PEEK), a polycarbonate, a polymeric resin and an epoxy resin.

The reinforcing elements may comprise at least one of fibres, strands, filaments and nanotubes. The reinforcing elements may comprise at least one of polymeric element, aramid element, non-polymeric element, carbon elements, glass elements and basalt elements.

The riser system may comprise a device for providing additional axial compliance to that provided by the riser connected between the floating body and the subsea location. The riser system may comprise a compliant bellows connected between the floating body and the subsea location.

The riser system may comprise one or more fibre optic strain sensors.

The riser may be configured to bend in a predetermined manner. This may be achieved by configuration of the composite material.

The riser system may define a Compliant Vertical Access Riser (CVAR) system.

An aspect of the present invention may relate to a riser system comprising a riser to be secured between a floating body and a subsea location, the riser comprising a composite material formed of at least a matrix and one or more reinforcing elements embedded within the matrix. In use, the riser may define a non-linear spatial arrangement. The composite material and the non-linear spatial arrangement may together accommodate motion of the floating body relative to the subsea location.

An aspect of the present invention may relate to a method for providing a riser between a floating body and a subsea location, comprising:

connecting a riser between the floating body and a subsea location, wherein the riser comprises a composite material formed of at least a matrix and one or more reinforcing elements embedded within the matrix;

configuring an upper portion of the riser extending from the floating body to have a region in tension;

configuring a lower portion of the riser extending from the subsea location to have a region in tension; and configuring an intermediate portion of the riser located between the upper and lower portions to have a region in compression.

An aspect of the present invention may relate to a compliant vertical access riser comprising a composite material formed of at least a matrix and one or more reinforcing elements embedded within the matrix.

An aspect of the present invention may relate to a riser system comprising a riser configured to be secured between a floating body and a subsea location, the riser comprising a composite material formed of at least a matrix and one or more reinforcing elements embedded within the matrix, said composite material being configured to accommodate motion of the floating body relative to the subsea location.

The motion may include vertical and/or lateral relative motion of the floating body relative to the subsea location. The motion may be caused by sea conditions such as waves, tides or the like. The motion may comprise heave, pitch, yaw or roll motion or any combination thereof.

The floating body may comprise a vessel such as a Floating Production Storage and Offloading (FPSO) vessel or a floating platform such as a Tension Leg Platform (TLP), SPAR platform, a semi-submersible platform or the like.

The subsea location may be fixed.

The subsea location may be a seabed location.

The riser may be configured to be secured to a fluid port at the subsea location such as a fluid port of a wellhead arrangement or a fluid port of a manifold or the like. For example, the riser may be configured to be secured to a fluid port of a Christmas tree or a manifold located on the seabed.

The composite material may be configured to withstand or permit axial and/or bending strains of up to 6%, up to 4%, up to 2% or up to 1%. Such a riser may allow attachment of the riser between the floating body and the subsea location with minimal or without active compensation of the motion of the floating body relative to the subsea location and with minimal or without the use of flexible interconnects between the riser and the floating body.

Such maximum permitted strains for the composite material may be significantly larger than a maximum permitted strain for a conventional material such as steel or the like. Accordingly, a riser comprising such a composite material may provide a compliant riser by virtue of the properties of the composite material alone.

Such maximum permitted strains for the composite material may also provide sufficient compliance to accommodate connection of the riser between the floating body and the subsea location thereby simplifying deployment of the riser.

Such maximum permitted strains may also permit greater manufacturing tolerances for the composite riser compared with the manufacturing tolerances required for a riser formed from a conventional material such as steel or the like.

The riser may extend substantially linearly between the floating body and the subsea location. For example, the riser may extend substantially vertically between the floating body and the subsea location.

At least a portion of the riser may be maintained in tension.

The riser geometry and/or density may be selected to provide a predetermined tension in the riser. Controlling the riser geometry and/or density may permit control of the riser length, weight and/or buoyancy for the control of tension in the riser for a given depth of water.

At least a portion of the riser may be maintained in compression.

The composite material may be configured to ensure that a thermally induced strain in the riser for a predetermined temperature change constitutes a smaller proportion of the maximum permitted strain for the riser than for a riser formed from a conventional material such as steel or the like. Risers comprising such a composite material may have a greater permissible strain range once thermally induced strain changes are taken into account than risers comprising conventional material such as steel or the like.

For example, the composite material may be configured to ensure that a thermally induced strain in the riser for a temperature change of up to 500° C., a temperature change of up to 200° C., a temperature change of up to 100° C. or a temperature change of up to 80° C. constitutes a smaller proportion of the maximum permitted strain in the riser than for a riser formed from a conventional material such as steel or the like.

The riser may comprise a feature such as a flange, lug, projection, hole, recess or the like for connection of the riser to the floating body or the subsea location.

The matrix may comprise a polymer material. The matrix may comprise a thermoplastic material. The matrix may comprise a thermoset material. The matrix may comprise a polyaryl ether ketone, a polyaryl ketone, a polyether ketone (PEK), a polyether ether ketone (PEEK), a polycarbonate or the like, or any suitable combination thereof. The matrix may comprise a polymeric resin, such as an epoxy resin or the like.

The reinforcing elements may comprise continuous or elongate elements. The reinforcing elements may comprise any one or combination of polymeric fibres, for example aramid fibres, or non-polymeric fibres, for example carbon, glass or basalt elements or the like. The reinforcing elements may comprise fibres, strands, filaments, nanotubes or the like. The reinforcing elements may comprise discontinuous elements.

The matrix and the reinforcing elements may comprise similar or identical materials. For example, the reinforcing elements may comprise the same material as the matrix, albeit in a fibrous, drawn, elongate form or the like.

The riser may comprise a pipe having a pipe wall comprising the composite material, wherein the pipe wall comprises or defines a local variation in construction to provide a local variation in a property of the pipe.

Such a local variation in a property of the pipe may permit tailoring of a response of the riser to given load conditions.

Such a local variation in a property of the pipe may, in particular, permit the riser design to be optimised to facilitate and withstand bending in localised regions such that other regions of the riser need only be designed to withstand reduced or zero bending stresses. Accordingly, such a riser may eliminate the requirement for all regions of the riser to be designed for the worst case dynamic load, thus potentially leading to reduced manufacturing costs and superior mechanical performance.

The local variation in construction may comprise at least one of a circumferential variation, a radial variation and an axial variation in the riser material and/or the pipe geometry.

The local variation in construction may comprise a local variation in the composite material.

The local variation in construction may comprise a variation in the matrix material. The local variation in construction may comprise a variation in a material property of the matrix material such as the strength, stiffness, Young's modulus, density, thermal expansion coefficient, thermal conductivity, or the like.

The local variation in construction may comprise a variation in the reinforcing elements. The local variation in construction may comprise a variation in a material property of the reinforcing elements such as the strength, stiffness, Young's modulus, density, distribution, configuration, orientation, pre-stress, thermal expansion coefficient, thermal conductivity or the like. The local variation in construction may comprise a variation in an alignment angle of the reinforcing elements within the composite material. In such an arrangement the alignment angle of the reinforcing elements may be defined relative to the longitudinal axis of the pipe. For example, an element provided at a 0 degree alignment angle will run entirely longitudinally of the pipe, and an element provided at a 90 degree alignment angle will run entirely circumferentially of the pipe, with elements at intermediate alignment angles running both circumferentially and longitudinally of the pipe, for example in a spiral or helical pattern.

The local variation in the alignment angle may include elements having an alignment angle of between, for example, 0 and 90 degrees, between 0 and 45 degrees or between 0 and 20 degrees.

At least one portion of the pipe wall may comprise a local variation in reinforcing element pre-stress. In this arrangement the reinforcing element pre-stress may be considered to be a pre-stress, such as a tensile pre-stress and/or compressive pre-stress applied to a reinforcing element during manufacture of the pipe, and which pre-stress is at least partially or residually retained within the manufactured pipe. A local variation in reinforcing element pre-stress may permit a desired characteristic of the pipe to be achieved, such as a desired bending characteristic. This may assist to position or manipulate the pipe, for example during installation, retrieval, coiling or the like. Further, this local variation in reinforcing element pre-stress may assist to shift a neutral position of strain within the pipe wall, which may assist to provide more level strain distribution when the pipe is in use, and/or for example is stored, such as in a coiled configuration.

The riser may comprise a first portion formed from the composite material and a second portion formed from a material other than a composite material.

The riser system may comprise a device for providing additional axial compliance to that provided by the riser connected between the floating body and the subsea location. For example, the riser system may comprise a compliant bellows or the like connected between the floating body and the subsea location.

The device for providing additional axial compliance may be connected to the floating body by a first riser portion. The device for providing additional axial compliance may be connected to the subsea location by a second riser portion.

The riser may comprise one or more strain sensors. For example, the riser may comprise a distributed strain sensor such as a fibre optic strain sensor. The riser may comprise one or more discrete strain sensors. The one or more strain sensors may be attached to the riser. For example, the one or more strain sensors may be mounted on a surface of the riser or at least partially embedded within a wall of the riser.

Such strain sensors may be used to monitor axial, torsional, hoop and/or bending strains in the riser under dynamic load conditions. In the event of excessive dynamic loads, fluid flow through the riser may be interrupted according to strain signals sensed by the strain sensors before damage is caused to the riser. This may serve to reduce or prevent leakage of fluid from the riser to the subsea environment.

An aspect of the present invention may relate to a riser system comprising:

a floating body; and a riser extending between the floating body and a subsea location, the riser comprising a composite material formed of at least a matrix and one or more reinforcing elements embedded within the matrix.

The riser may be provided in accordance with any other aspect defined herein.

The composite material may be configured to accommodate motion of the floating body relative to the subsea location.

An aspect of the present invention may relate to a riser system comprising a riser configured to be secured between a floating body and a subsea location, the riser comprising a composite material formed of at least a matrix and one or more reinforcing elements embedded within the matrix, said riser configured to define a non-linear spatial arrangement to accommodate motion of the floating body relative to the subsea location.

The motion may include vertical and/or lateral relative motion of the floating body relative to the subsea location. The motion may be caused by sea conditions such as waves, tides or the like. The motion may comprise heave, pitch, yaw or roll motion or any combination thereof.

Such a riser system may provide compliance between the floating body relative to the subsea location not only by virtue of the properties of the composite material, but also by virtue of the spatial arrangement of the riser.

The riser may comprise a non-linear portion.

The spatial arrangement of the riser may comprise a point of inflection.

The riser may comprise a generally linear upper portion extending from the floating body, a generally linear lower portion extending from the subsea location and an intermediate portion extending between the upper and lower portions.

The intermediate portion may be generally non-linear.

The riser system may be configured such that the upper portion of the riser is in tension, the lower portion of the riser is in tension and the intermediate portion is in compression. The configuration of the riser may be selected to provide a predetermined tension in the upper and/or lower portions. For example, the density and/or geometry of the riser may be selected to provide a predetermined tension in the upper and/or lower portions.

The configuration of the riser may be selected to provide a predetermined compression in the intermediate portion. For example, the density and/or geometry of the riser may be selected to provide a predetermined compression in the intermediate portion.

The composite riser is much lighter than a riser made from a conventional material such as steel with the result that the composite riser is closer to neutral buoyancy in sea water than a steel riser. Accordingly, the use of a composite riser may mitigate or eliminate the need to attach additional weights and/or buoyancy elements to the riser to provide the appropriate tension or compression in one of the portions of the riser.

The riser may define a Compliant Vertical Access Riser (CVAR).

The riser may be configured to bend in a predetermined manner. This may serve to make bending of the riser more predictable thus simplifying the design of the riser for a given range of dynamic load conditions. This may avoid the action of any unpredictable loads on the riser which may lead to damage or failure of the riser due, for example, to buckling.

The riser may be configured to bend at a predetermined axial position or over a predetermined axial portion. For example, the riser may be configured to have a reduced bending stiffness at a predetermined axial position.

The riser may be configured to bend in a predetermined plane. For example, the riser may be configured to have a reduced stiffness in a predetermined plane.

The riser may be configured to withstand a predetermined degree of bending, for example, bending at a predetermined axial position or over a predetermined axial portion and/or in a predetermined plane.

Such a riser may therefore be optimised to facilitate and withstand bending in localised regions requiring that other regions of the riser only be designed to withstand reduced or zero bending stresses. Accordingly, such a riser may eliminate the requirement for all regions of the riser to be designed for the worst case dynamic load, thus potentially leading to reduced manufacturing costs and superior mechanical performance.

The riser may comprise one or more strain sensors. For example, the riser may comprise a distributed strain sensor such as a fibre optic strain sensor. The riser may comprise one or more discrete strain sensors. The one or more strain sensors may be attached to the riser. For example, the one or more strain sensors may be mounted on a surface of the riser or at least partially embedded within a wall of the riser.

Such strain sensors may be used to monitor axial and/or bending strains in the riser under dynamic load conditions. In the event of excessive dynamic loads, fluid flow through the riser may be interrupted according to strain signals sensed by the strain sensors before damage is caused to the riser. This may serve to reduce or prevent leakage of fluid from the riser to the subsea environment.

The riser may comprise a pipe having a pipe wall comprising the composite material, wherein the pipe wall comprises or defines a local variation in construction to provide a local variation in a property of the pipe.

The local variation in construction may comprise at least one of a circumferential variation, a radial variation and an axial variation in the riser material and/or the pipe geometry.

The local variation in construction may comprise a local variation in the composite material.

The local variation in construction may comprise a variation in the matrix material. The local variation in construction may comprise a variation in a material property of the matrix material such as the strength, stiffness, Young's modulus, density, thermal expansion coefficient, thermal conductivity, or the like.

The local variation in construction may comprise a variation in the reinforcing elements. The local variation in construction may comprise a variation in a material property of the reinforcing elements such as the strength, stiffness, Young's modulus, density, distribution, configuration, orientation, pre-stress, thermal expansion coefficient, thermal conductivity or the like. The local variation in construction may comprise a variation in an alignment angle of the reinforcing elements within the composite material. In such an arrangement the alignment angle of the reinforcing elements may be defined relative to the longitudinal axis of the pipe. For example, an element provided at a 0 degree alignment angle will run entirely longitudinally of the pipe, and an element provided at a 90 degree alignment angle will run entirely circumferentially of the pipe, with elements at intermediate alignment angles running both circumferentially and longitudinally of the pipe, for example in a spiral or helical pattern.

The local variation in the alignment angle may include elements having an alignment angle of between, for example, 0 and 90 degrees, between 0 and 45 degrees or between 0 and 20 degrees.

At least one portion of the pipe wall may comprise a local variation in reinforcing element pre-stress. In this arrangement the reinforcing element pre-stress may be considered to be a pre-stress, such as a tensile pre-stress and/or compressive pre-stress applied to a reinforcing element during manufacture of the pipe, and which pre-stress is at least partially or residually retained within the manufactured pipe. A local variation in reinforcing element pre-stress may permit a desired characteristic of the pipe to be achieved, such as a desired bending characteristic. This may assist to position or manipulate the pipe, for example during installation, retrieval, coiling or the like. Further, this local variation in reinforcing element pre-stress may assist to shift a neutral position of strain within the pipe wall, which may assist to provide more level strain distribution when the pipe is in use, and/or for example is stored, such as in a coiled configuration.

The riser may comprise a first portion formed from the composite material and a second portion formed from a material other than a composite material.

An aspect of the present invention may relate to a flowline jumper configured to be secured between two subsea locations, said jumper comprising a composite material formed of at least a matrix and one or more reinforcing elements embedded within the matrix.

The jumper may define a non-linear spatial arrangement to provide compliance for the jumper between the subsea locations.

The jumper may be configured to be secured between two seabed locations.

The jumper may be configured to be secured between two subsea fluid ports.

The jumper may provide compliance to accommodate connection of the jumper between the seabed locations.

The spatial arrangement of the jumper may provide compliance when the jumper is connected between the seabed locations to thereby withstand dynamic load conditions such as subsea dynamic load conditions.

The jumper may have a non-linear portion.

The jumper may be curved.

The jumper may define a pig-tail shape, an "omega" shape, or may be formed into a coil such as a helix, spiral or the like.

Such shapes may permit relatively large movements in compact space envelopes. Such shapes may, in particular, permit relatively large movements without strain levels in the jumper exceeding maximum permitted strain levels The jumper composite material may be configured to provide compliance which is additional to the compliance provided by the spatial arrangement of the jumper.

For example, the composite material may be configured to withstand or permit axial and/or bending strains of up to 6%, up to 4%, up to 2% or up to 1%.

The material properties of such a composite jumper may provide enhanced immunity to damage such as damage caused by buckling under dynamic load conditions The material properties of such a composite jumper may permit manufacturing tolerances to be relaxed compared with manufacturing tolerances when using a conventional material such as steel or the like.

The material properties of such a composite jumper may ease installation. This may be particularly important in a subsea environment where manipulation of the jumper between the two seabed locations and securing of the jumper at the two seabed locations may be challenging.

The composite material may be configured to ensure that a thermally induced strain in the jumper for a predetermined temperature change constitutes a smaller proportion of the maximum permitted strain in the jumper than for a jumper formed from a conventional material such as steel or the like. Jumpers comprising such a composite material may have a greater permissible strain range once thermally induced strain changes are taken into account than jumpers comprising conventional material such as steel or the like.

For example, the composite material may be configured to ensure that a thermally induced strain for a temperature change of up to 500° C., a temperature change of up to 200° C., a temperature change of up to 100° C. or a temperature change of up to 80° C. constitutes a smaller proportion of the maximum permitted strain than for a conventional material such as steel or the like.

The jumper may comprise a feature such as a flange, lug, projection, hole, recess or the like for connection of the jumper to the fluid ports.

The matrix may comprise a polymer material.

The matrix may comprise a thermoplastic material.

The use of a matrix comprising a thermoplastic material may permit the jumper to be manufactured by first forming a fluid conduit, for example a substantially linear fluid conduit, and subsequently forming the fluid conduit so as to provide the fluid conduit with a non-linear spatial arrangement. Such composite materials may permit the fluid conduit to be formed into a curved shape such as a pig-tail shape, an "omega" shapes, or a coil such as a helix or a spiral or the like.

Such composite materials may permit the fluid conduit to be integrally formed into a continuous curved shape.

Such jumpers may retain their shape during deployment and recovery thus making the jumpers easier to manipulate.

Such jumpers may be configured to have a curvature less than a maximum threshold curvature. This may reduce the risk of hydrate build up as a result of a flow of hydrocarbon fluids through the jumper. This may also present less of a restriction for hydrate removal operations such as pigging operations.

The matrix may comprise a thermoset material.

The matrix may comprise a polyaryl ether ketone, a polyaryl ketone, a polyether ketone (PEK), a polyether ether ketone (PEEK), a polycarbonate or the like, or any suitable combination thereof. The matrix may comprise a polymeric resin, such as an epoxy resin or the like.

The reinforcing elements may comprise continuous or elongate elements. The reinforcing elements may comprise any one or combination of polymeric fibres, for example aramid fibres, or non-polymeric fibres, for example carbon, glass or basalt elements or the like. The reinforcing elements may comprise fibres, strands, filaments, nanotubes or the like. The reinforcing elements may comprise discontinuous elements.

The matrix and the reinforcing elements may comprise similar or identical materials. For example, the reinforcing elements may comprise the same material as the matrix, albeit in a fibrous, drawn, elongate form or the like.

The jumper may comprise a pipe having a pipe wall comprising the composite material, wherein the pipe wall comprises or defines a local variation in construction to provide a local variation in a property of the pipe.

Such a local variation in a property of the pipe may permit tailoring of a response of the jumper to given load conditions.

Such a local variation in a property of the pipe may, in particular, permit the jumper design to be optimised to facilitate and withstand bending in localised regions such that other regions of the jumper need only be designed to withstand reduced or zero bending stresses. Accordingly, such a jumper may eliminate the requirement for all regions of the jumper to be designed for the worst case dynamic load, thus potentially leading to reduced manufacturing costs and superior mechanical performance.

The local variation in construction may comprise at least one of a circumferential variation, a radial variation and an axial variation in the jumper material and/or the pipe geometry.

The local variation in construction may comprise a local variation in the composite material.

The local variation in construction may comprise a variation in the matrix material. The local variation in construction may comprise a variation in a material property of the matrix material such as the strength, stiffness, Young's modulus, density, thermal expansion coefficient, thermal conductivity, or the like.

The local variation in construction may comprise a variation in the reinforcing elements. The local variation in construction may comprise a variation in a material property of the reinforcing elements such as the strength, stiffness, Young's modulus, density, distribution, configuration, orientation, pre-stress, thermal expansion coefficient, thermal conductivity or the like. The local variation in construction may comprise a variation in an alignment angle of the reinforcing elements within the composite material. In such an arrangement the alignment angle of the reinforcing elements may be defined relative to the longitudinal axis of the pipe. For example, an element provided at a 0 degree alignment angle will run entirely longitudinally of the pipe, and an element provided at a 90 degree alignment angle will run entirely circumferentially of the pipe, with elements at intermediate alignment angles running both circumferentially and longitudinally of the pipe, for example in a spiral or helical pattern.

The local variation in the alignment angle may include elements having an alignment angle of between, for example, 0 and 90 degrees, between 0 and 45 degrees or between 0 and 20 degrees.

At least one portion of the pipe wall may comprise a local variation in reinforcing element pre-stress. In this arrangement the reinforcing element pre-stress may be considered to be a pre-stress, such as a tensile pre-stress and/or compressive pre-stress applied to a reinforcing element during manufacture of the pipe, and which pre-stress is at least partially or residually retained within the manufactured pipe. A local variation in reinforcing element pre-stress may permit a desired characteristic of the pipe to be achieved, such as a desired bending characteristic. This may assist to position or manipulate the pipe, for example during installation, retrieval, coiling or the like. Further, this local variation in reinforcing element pre-stress may assist to shift a neutral position of strain within the pipe wall, which may assist to provide more level strain distribution when the pipe is in use, and/or for example is stored, such as in a coiled configuration.

The jumper may comprise a first portion formed from the composite material and a second portion formed from a material other than a composite material.

An aspect of the present invention may relate to a flow-line jumper arrangement comprising a flow-line jumper extending between two subsea locations, said jumper comprising a composite material formed of at least a matrix and one or more reinforcing elements embedded within the matrix and said jumper defining a non-linear spatial arrangement configured to provide compliance for the jumper between the subsea locations.

The flow-line jumper may be secured between the two subsea locations.

It should be understood that one or more of the optional features described in relation to the fifth aspect may apply alone or in any combination in relation to the sixth aspect.

An aspect of the present invention may relate to a method of forming a flow-line jumper configured to be secured between two subsea locations comprising:

forming a linear fluid conduit from a composite material formed of at least a thermoplastic matrix and one or more reinforcing elements embedded within the matrix; and forming the fluid conduit so as to provide the fluid conduit with a non-linear spatial arrangement.

It should be understood that one or more of the features described in relation to one aspect may apply alone or in any combination in relation to any other aspect.

BRIEF DESCRIPTION OF THE DRAWINGS

The present invention will now be described by way of non-limiting example only with reference to the accompanying drawings of which:

FIG. 3(*b*) is a schematic view of the riser system of FIG. 3(*a*) with weights and buoyancy elements attached to a riser of the riser system;

FIG. 4(*b*) is a schematic end elevation of the flow-line jumper of FIG. 4(*a*)

DETAILED DESCRIPTION OF THE DRAWINGS

Figure 1:
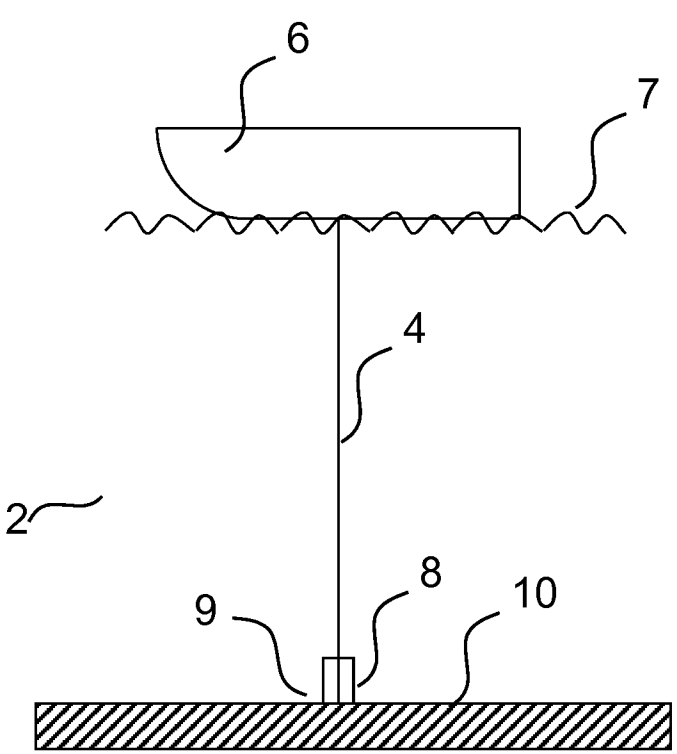
FIG. 1 is a schematic view of a riser system.

With reference initially to FIG. 1, there is shown a riser system generally designated 2 comprising a composite riser 4 secured between a vessel 6 floating on the sea surface 7 and a fixed tree arrangement 8 at a subsea location 9 on the seabed 10. The riser 4 extends substantially vertically between the vessel 6 and the tree arrangement 8. The length, weight and/or buoyancy of the riser 4 are selected to provide a predetermined tension in the riser 4 for a given depth of water.

The riser 4 comprises a composite material formed of a matrix of polyether ether ketone (PEEK) and carbon fibre reinforcing elements (not shown) embedded within the PEEK matrix. The composite material of the riser 4 comprises a plurality of axially oriented carbon fibre reinforcing elements. As a result of this composite structure, the particular riser 4 shown in FIG. 1 may permit large axial or bending strains, for example, axial or bending strains of up to 2% or more. This compares with typical maximum permissible axial or bending strains of a steel riser which may be in the region of approximately 0.1%. Thus, the composite riser 4 offers significantly more compliance by virtue of its material properties alone compared with a conventional steel riser. Accordingly, the material properties of the riser 4 compensate for the heave motion of the floating body 6 relative to the tree arrangement 8, thus allowing attachment of the riser 4 between the vessel 6 and the tree arrangement 8 without the need for any active heave compensation mechanisms such as hydraulic rams or the like.

The material properties of the riser 4 also ensure that a thermally induced strain in the riser 4 for a given temperature change constitutes a significantly smaller proportion of the maximum permitted strain in the riser 4 than for a conventional steel riser. For example, for a temperature change of approximately 80° C., the thermally induced strain in the riser 4 constitutes a significantly smaller proportion of the maximum permitted strain in the riser 4 than for a conventional steel riser. The riser 4 thus has a greater permissible strain range once thermally induced strain changes are taken into account compared with a steel riser.

Figure 2:
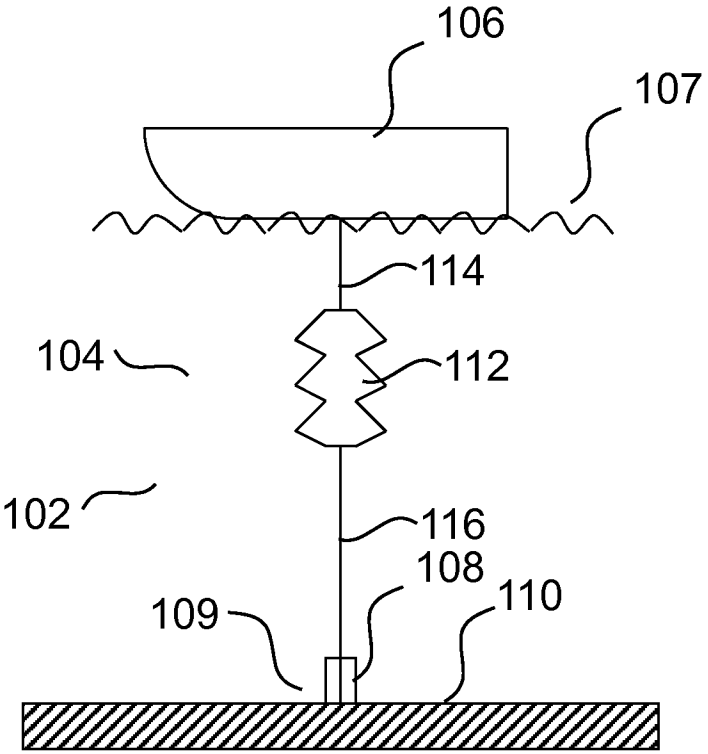
FIG. 2 is a schematic view of an alternative riser system.

Referring now to FIG. 2, there is shown an alternative riser system generally designated 102 comprising a composite riser generally designated 104 configured to be secured between a body such as a vessel 106 floating on the sea surface 107 and a fixed tree arrangement 108 at subsea location 109 on the seabed 110. The riser 104 further comprises a bellows 112 which are connected to the vessel 106 by an upper riser portion 114 and are connected to the tree arrangement 108 by a lower riser portion 116. The riser 104 extends substantially vertically between the vessel 106 and the tree arrangement 8. The length, weight and/or buoyancy of the riser 104 and the bellows 112 are selected to provide a predetermined tension in the riser 104 for a given depth of water.

The bellows 112 provide additional compliance to further mitigate the effects of heave motion of the floating body 106 relative to the tree arrangement 108 if necessary in, for example, heavy sea conditions. In all other respects the riser system 102 of FIG. 2 is identical to the riser system 2 of FIG. 1.

Figure 3:
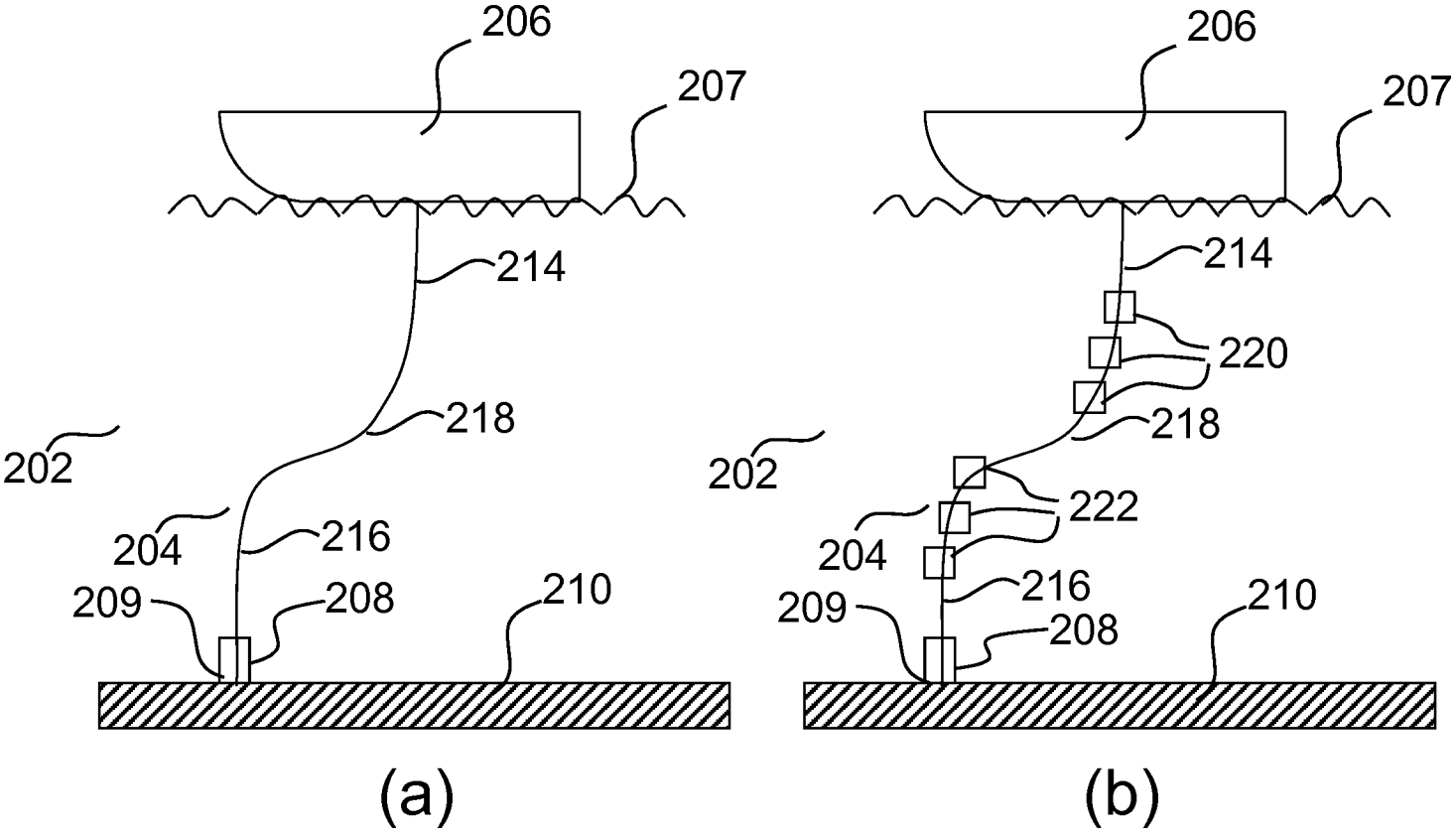
FIG. 3(*a*) is a schematic view of a further riser system.

FIG. 3(*a*) shows a further riser system generally designated 202 comprising a composite riser 204 secured between a vessel 206 floating on the sea surface 207 and a fixed tree arrangement 208 at a subsea location 209 on the seabed 210. The length of the riser 204 is greater than the depth of the water so that the riser 204 assumes a non-linear spatial arrangement.

The riser 204 comprises a composite material formed of a matrix of polyether ether ketone (PEEK) and carbon fibre reinforcing elements (not shown) embedded within the PEEK matrix. The composite material of the riser 204 comprises a plurality of axially oriented carbon fibre reinforcing elements.

As a result of this composite structure, the particular riser 204 shown in FIG. 3(*a*) may permit large axial or bending strains, for example, axial or bending strains of up to 2% or more. This compares with typical maximum permissible axial or bending strains of a steel riser which may be in the region of approximately 0.1%. Thus, the composite riser 204 offers significantly more compliance by virtue of its material properties alone compared with a conventional steel riser.

Thus, the material properties of the composite riser 204 may serve to increase the compliance provided by the non-linear spatial arrangement of the riser 204. The combined compliance of the riser system 202 compensates for the heave motion of the floating body 206 relative to the tree arrangement 208, thus allowing attachment of the riser 204 between the vessel 206 and the tree arrangement 208 without any active heave compensation mechanisms such as hydraulic rams or the like.

The material properties of the composite riser 204 also ensure that a thermally induced strain in the riser 204 for a given temperature change constitutes a significantly smaller proportion of the maximum permitted strain in the riser 204 than for a conventional steel riser. For example, for a temperature change of approximately 80° C., the thermally induced strain in the riser 204 constitutes a significantly smaller proportion of the maximum permitted strain in the riser 204 than for a conventional steel riser. The riser 204 thus has a greater permissible strain range once thermally induced strain changes are taken into account compared with a steel riser.

The riser 204 comprises an upper portion 214 which extends generally downwardly from the vessel 206, a lower portion 216 which extends generally upwardly from the tree arrangement 208 and, an intermediate portion 218 which extends between the upper and lower portions 214, 216.

The riser system 202 is configured such that the upper portion 214 of the riser 204 is in tension, the lower portion 216 of the riser 204 is in tension and the intermediate portion 218 of the riser 204 is in compression. The configuration of the riser 204 is selected to provide a desired tension in the upper and lower portions. In particular, the density and geometry of the riser are selected to provide a predetermined tension in the upper and lower portions 214, 216.

The composite riser 204 is much lighter than a conventional steel riser with the result that the composite riser 204 is closer to neutral buoyancy in sea water than a steel riser. Accordingly, the use of a composite material for the riser 204 may mitigate or eliminate the need to attach weights and/or buoyancy elements to the riser 204 to provide the appropriate tension in the upper and lower portions 214, 216 of the riser 204 and the appropriate compression in the intermediate portion 218 of the riser 204. However, where necessary, as shown in FIG. 3(*b*), the riser system 202 may further comprise weights 220 which serve to tension the upper portion 214 of the riser 204 to ensure that the upper portion 214 extends generally vertically downwardly from the vessel 206. The riser system 202 may further comprise buoyancy elements 222 which serve to tension the lower portion 216 of the riser 204 to ensure that the lower portion 216 extends generally vertically upwardly from the tree arrangement 208. As a result of the combined effect of the weights 220 and the buoyancy elements 222, the intermediate portion 218 adopts a predetermined desired "S"-shaped spatial arrangement.

Figure 4:
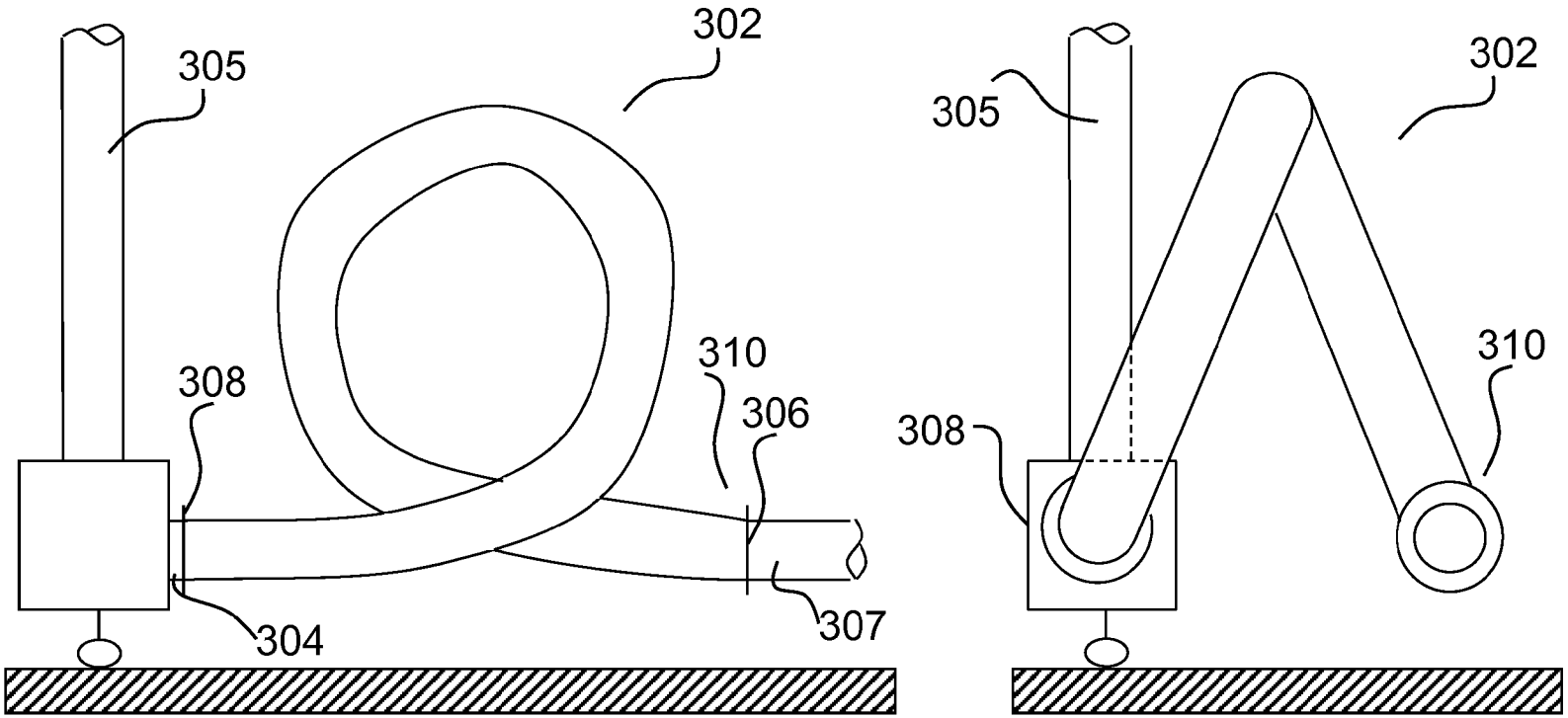
FIG. 4(*a*) is a schematic front elevation of a flow-line jumper.

FIG. 4 shows a composite "pig-tail" shaped subsea flowline jumper generally designated 302 for connection between a first subsea fluid port 304 for connection to a riser 305 and a second subsea fluid port 306 for connection to a fluid conduit 307. By virtue of its non-linear geometry, the jumper 302 permits a relatively large movement of the jumper ends 308 and 310 with respect to one another in a compact space envelope.

The jumper 302 comprises a composite material formed of a matrix of polyether ether ketone (PEEK) and carbon fibre reinforcing elements (not shown) embedded within the PEEK matrix. The composite material of the jumper 302 comprises a plurality of axially oriented carbon fibre reinforcing elements. As a result of this composite structure, the particular jumper 302 shown in FIG. 4 may permit large axial or bending strains, for example, axial or bending strains of up to 2% or more. This compares with typical maximum permissible axial or bending strains of a steel jumper which may be in the region of approximately 0.1%. Thus, the composite jumper 302 offers significantly more compliance by virtue of its material properties alone compared with a conventional steel jumper. Thus, the material properties of the composite jumper 302 serve to increase the compliance provided by the non-linear spatial arrangement of the jumper 302.

The material properties of the composite jumper 302 also ensure that a thermally induced strain in the jumper 302 for a given temperature change constitutes a significantly smaller proportion of the maximum permitted strain in the jumper 302 than for a conventional steel jumper. For example, for a temperature change of approximately 80° C., the thermally induced strain in the jumper 302 constitutes a significantly smaller proportion of the maximum permitted strain in the jumper 302 than for a conventional steel jumper.

Figure 5:
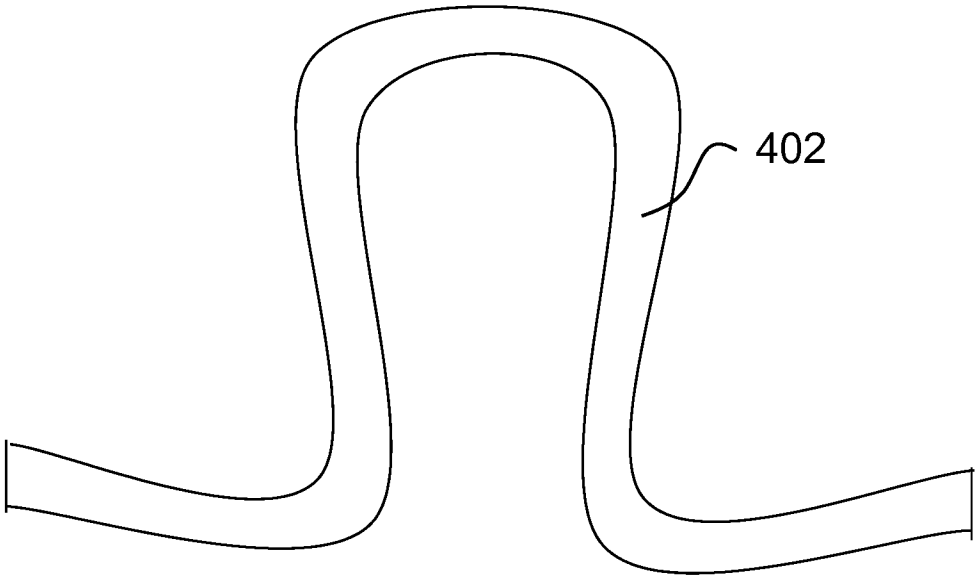
FIG. 5 is a schematic view of a further flow-line jumper.

The material properties of the composite jumper 302 provide enhanced immunity to damage such as that caused by buckling under dynamic load conditions. The material properties of the composite jumper 302 permit manufacturing tolerances to be relaxed compared with manufacturing tolerances when using a conventional material such as steel or the like. The material properties of the composite jumper 302 also ease installation. This may be particularly important in a subsea environment where manipulation of the jumper 302 between the two fluid ports 304, 306 and securing of the jumper 302 at the two fluid ports 304, 306 may be challenging. In addition, the The use of thermoplastic PEEK matrix also permits the jumper 302 to be manufactured by first forming a fluid conduit, for example a substantially linear fluid conduit, and subsequently forming the fluid conduit into the pig-tail spatial arrangement shown in FIG. 4. This results in an integrally formed composite jumper 302 which may have fewer, more gradual bends. This may reduce or suppress hydrate build up as a result of a flow of hydrocarbon fluids through the jumper. This may also present less of a restriction for hydrate removal operations such as pigging operations. thus facilitating removal of hydrate build by pigging. Other non-linear composite jumper spatial arrangements are also possible. For example, FIG. 5 shows an "omega"—shaped composite jumper 402 which only differs from the "pig-tail" shaped composite jumper 302 of FIG. 4 in the exact non-linear spatial arrangement thereof One skilled in the art will understand that various other riser and jumper spatial arrangements are possible without departing from the scope of the present invention. For example, coiled spatial arrangements such as helical or spiral spatial arrangements may be used to provide compliant risers and jumpers.

The invention claimed is:

1. A riser system comprising a riser to be secured between a floating body and a subsea location, the riser comprising a composite material formed of at least a matrix and one or more reinforcing elements embedded within the matrix, wherein, in use, the riser comprises an upper portion extending from the floating body and having a region arranged to be always in tension, a lower portion extending from the subsea location and having a region arranged to be always in tension, and an intermediate portion located between the upper and lower portions and having a region arranged to be in compression;

wherein, the riser comprises a pipe having a pipe wall comprising the composite material, wherein the pipe wall comprises or defines a local variation in construction of a local region of the intermediate portion to provide a local variation in a property of the pipe such that the riser bends in a predetermined manner such that the riser bends at a predetermined axial position or over a predetermined axial portion or bend in a predetermined plane; and wherein the local variation in construction comprises one or more of the following a local variation in the composite material, a local variation in the matrix, and a local variation in the one or more reinforcing elements.

2. The riser system according to claim 1, wherein the riser provides a predetermined tension in the upper or lower portions or a predetermined compression in the intermediate portion.

3. The riser system according to claim 2, wherein the density or geometry of the riser provide the predetermined tension in the upper or lower portions and the predetermined compression in the intermediate portion.

4. The riser system according to claim 1, wherein at least a portion of the riser defines a non-linear spatial arrangement to accommodate motion of the floating body relative to the subsea location.

5. The riser system according to claim 1, wherein the intermediate portion defines a non-linear spatial arrangement.

6. The riser system according to claim 1, wherein the upper portion of the riser extends generally linearly from the floating body towards the intermediate portion.

7. The riser system according to claim 1, wherein the lower portion of the riser extends generally linearly from the subsea location towards the intermediate portion.

8. The riser system according to claim 1, wherein a spatial arrangement of the riser comprises a point of inflection.

9. The riser system according to claim 1, comprising weights or buoyancy elements attached to the riser.

10. The riser system according to claim 1, wherein the riser is secured to a fluid port at the subsea location.

11. The riser system according to claim 1, wherein the composite material permits axial or bending strains of up to 6%, up to 4%, up to 2% or up to 1%.

12. The riser system according to claim 1, wherein the composite material is selected to ensure that a thermally induced strain in the riser for a predetermined temperature change constitutes a smaller proportion of a maximum permitted strain in the riser than for a steel riser.

13. The riser system according to claim 1, wherein the composite material is selected to ensure that a thermally induced strain in the riser for a temperature change of up to 500° C., a temperature change of up to 200° C., a temperature change of up to 100° C. or a temperature change of up to 80° C. constitutes a smaller proportion of a maximum permitted strain in the riser than for a steel riser.

14. The riser system according to claim 1, wherein the matrix comprises a polymer material.

15. The riser system according to claim 1, wherein the matrix comprises a thermoplastic material or a thermoset material.

16. The riser system according to claim 1, wherein the matrix comprises at least one of a polyaryl ether ketone, a polyaryl ketone, a polyether ketone (PEK), a polyether ether ketone (PEEK), a polycarbonate, a polymeric resin and an epoxy resin.

17. The riser system according to claim 1, wherein the reinforcing elements comprise at least one of fibres, strands, filaments and nanotubes.

18. The riser system according to claim 1, wherein the reinforcing elements comprise at least one of polymeric element, aramid element, non-polymeric element, carbon elements, glass elements and basalt elements.

19. The riser system according to claim 1, wherein the riser system comprises a device for providing additional axial compliance to that provided by the riser connected between the floating body and the subsea location.

20. The riser system according to claim 19, comprising a compliant bellows connected between the floating body and the subsea location.

21. The riser system according to claim 1, wherein the riser comprises one or more fibre optic strain sensors.

22. The riser system according to claim 1, wherein the riser comprises the upper portion extending from the floating body and having the region arranged to be always in tension, the lower portion extending from the subsea location and having the region arranged to be always in tension, and the intermediate portion located between the upper and lower portions and having the region arranged to be in compression, in use under static load conditions.

23. The riser system according to claim 1, wherein the local variation in construction provides a local variation in a property of the pipe so as to facilitate bending in localised regions such that, in use, the riser defines a non-linear spatial arrangement, such that the composite material and the non-linear spatial arrangement accommodate motion of the floating body relative to the subsea location.

24. A riser system comprising a riser to be secured between a floating body and a subsea location, the riser comprising a composite material formed of at least a matrix and one or more reinforcing elements embedded within the matrix, said riser, in use, defining a non-linear spatial arrangement, such that the composite material and the non-linear spatial arrangement accommodate motion of the floating body relative to the subsea location; and the riser comprises a pipe having a pipe wall comprising the composite material, wherein the pipe wall comprises or defines a local variation in construction of a local region of the intermediate portion to provide a local variation in a property of the pipe such that the riser bends in a predetermined manner such that the riser bends at a predetermined axial position or over a predetermined axial portion or bend in a predetermined plane, wherein the local variation in construction comprises one or more of the following, a local variation in the composite material, a local variation in the matrix, and a local variation in the one or more reinforcing elements.

25. A flow-line jumper for securing between two subsea locations, said jumper comprising a composite material formed of at least a matrix and one or more reinforcing elements embedded within the matrix and said flow-line jumper defining a non-linear spatial arrangement configured to provide compliance for the jumper between the two subsea locations; and a riser comprises a pipe having a pipe wall comprising a composite material, wherein the pipe wall comprises or defines a local variation in construction of a local region of the intermediate portion to provide a local variation in a property of the pipe such that the flow-line jumper bends in a predetermined manner such that the riser bends at a predetermined axial position or over a predetermined axial portion or bend in a predetermined plane, wherein the local variation in construction comprises one or more of the following, a local variation in the composite material, a local variation in the matrix, and a local variation in the one or more reinforcing elements.

26. The flow-line jumper according to claim 25, wherein the flow-line jumper has a non-linear portion.

27. The flow-line jumper according to claim 25, wherein the flow-line jumper defines at least one of a pig-tail shape, an omega shape, a coil, a helix and a spiral.

28. A method for providing a riser between a floating body and a subsea location, comprising:

connecting a riser between the floating body and a subsea location, wherein the riser comprises a composite material formed of at least a matrix and one or more reinforcing elements embedded within the matrix, wherein the riser comprises a pipe having a pipe wall comprising the composite material, wherein the pipe wall comprises or defines a local variation in construction of local region of the intermediate portion to provide a local variation in a property of the pipe such that the riser bends in a predetermined manner such that the riser bends at a predetermined axial position or over a predetermined axial portion or bend in a predetermined plane, wherein the local variation in construction comprises one or more of the following, a local variation in the composite material, a local variation in the matrix, and a local variation in the one or more reinforcing elements;

configuring at least a region of an upper portion of the riser extending from the floating body to be always in tension;

configuring at least a region of a lower portion of the riser extending from the subsea location to be always in tension; and configuring at least a region of an intermediate portion of the riser located between the upper and lower portions to be in compression.

* * * * *